US007036763B2

(12) United States Patent
Böhm et al.

(10) Patent No.: US 7,036,763 B2
(45) **Date of Patent: *May 2, 2006**

(54) WINDING APPARATUS AND METHOD FOR PERFORMING A CHANGE OF WINDING TUBE IN A WINDING APPARATUS

(75) Inventors: Andreas Böhm, Troisdorf (DE); Helmut Meyer, Troisdorf (DE)

(73) Assignee: Reifenhäuser GmbH & Co. Maschinenfabrik, Troisdorf (DE)

( * ) Notice: Subject to any disclaimer, the term of this patent is extended or adjusted under 35 U.S.C. 154(b) by 66 days.

This patent is subject to a terminal disclaimer.

(21) Appl. No.: 10/693,270

(22) Filed: Oct. 24, 2003

(65) Prior Publication Data

US 2004/0135023 A1 Jul. 15, 2004

(30) Foreign Application Priority Data

Oct. 25, 2002 (EP) ..... 02023945

(51) Int. Cl.
*B65H 18/14* (2006.01)

(52) U.S. Cl. ..... 242/542.3; 242/527.3; 242/532.2

(58) Field of Classification Search ..... 242/527.2, 242/527.3, 527.4, 532.2, 532.3, 542.3
See application file for complete search history.

(56) References Cited

U.S. PATENT DOCUMENTS

| | | | | |
|---|---|---|---|---|
| 3,350,027 | A | 10/1967 | Egan | |
| 4,196,865 | A | 4/1980 | Patriksson | |
| 4,444,362 | A | 4/1984 | Karr | |
| 4,445,646 | A | 5/1984 | Karr et al. | |
| 4,456,190 | A | 6/1984 | Karttunen et al. | |
| 4,695,004 | A | 9/1987 | Grossmann et al. | |
| 4,770,358 | A | 9/1988 | Suzuki et al. | |
| 4,798,351 | A | 1/1989 | Halter et al. | |
| 4,852,820 | A | 8/1989 | Looser | |
| 5,314,132 | A | 5/1994 | Ando et al. | |
| 5,954,291 | A | 9/1999 | Meinecke et al. | |
| 6,029,927 | A | 2/2000 | Wohlfahrt et al. | |
| 6,045,085 | A | 4/2000 | Andersson et al. | |
| 6,149,099 | A | 11/2000 | Meinecke et al. | |
| 6,474,589 | B1 | 11/2002 | Enwald et al. | |
| 6,752,348 | B1 * | 6/2004 | Dreckmann et al. | 242/542.3 |
| 2002/0179769 | A1 * | 12/2002 | Dreckmann et al. | 242/527.3 |
| 2004/0135023 | A1 * | 7/2004 | Bohm et al. | 242/527.2 |

FOREIGN PATENT DOCUMENTS

| | | |
|---|---|---|
| CH | 674 352 | 5/1990 |
| CH | 676 113 | 12/1990 |
| DE | 1 574 426 | 1/1972 |
| DE | 42 13 712 | 3/1995 |
| DE | 36 30 572 | 3/1998 |

(Continued)

*Primary Examiner*—William A. Rivera
(74) *Attorney, Agent, or Firm*—Pauley Petersen & Erickson

(57) ABSTRACT

A method and apparatus for winding a continuously delivered film web onto successively delivered winding tubes with a rotatably drivable contact roller, a winding station, associated with the contact roller, for the winding tube for winding the coil, a winding preparation station for receiving a new winding tube and beginning to wind the film web, and a transverse-cutting device for cutting the film web crosswise between the winding station and the winding preparation station. Associated with the winding preparation station for the new winding tube are a charger for generating an electrostatic charge of the new winding tube and a blower device for subjecting the film web to a blown air stream aimed counter to the feeding direction of the film web.

14 Claims, 5 Drawing Sheets

FOREIGN PATENT DOCUMENTS

| | | | |
|---|---|---|---|
| DE | 197 19 048 | A1 | 11/1998 |
| EP | 0 995 708 | A2 | 4/2000 |
| EP | 1 247 773 | A2 | 10/2002 |
| EP | 1 433 730 | A1 | 10/2002 |
| JP | 58-17048 | | 2/1983 |
| JP | 58220038 | | 12/1983 |
| JP | 60-197556 | | 10/1985 |
| JP | 61-130164 | | 6/1986 |

* cited by examiner

WINDING APPARATUS AND METHOD FOR PERFORMING A CHANGE OF WINDING TUBE IN A WINDING APPARATUS

BACKGROUND OF THE INVENTION

1. Field of the Invention

This invention relates to an apparatus for winding a continuously oncoming film web onto successively deliverable winding tubes, including a rotatably drivable contact roller for delivering the film web in a feeding direction, and including the following, associated with the contact roller: a winding station for the winding tube for winding the film web into a coil; a winding preparation station for receiving a new winding tube, which upon a change of winding tubes replaces the winding tube wound with a coil of the film web in the winding station; a transverse-cutting device for cutting the film web crosswise in the region between the winding station and the winding preparation station; and upon a change of winding tubes, the winding tube bearing the coil can be removed from the winding station, the transverse-cutting device for cutting the film web crosswise can be transferred from a position of repose into a working position, and upon severing of the film web, a leading end of the trailing film web is formed, the formed leading end of the film web can be delivered to the new winding tube located in the winding preparation station and wound onto the new winding tube, and the new winding tube, after receiving the leading end of the film web, can be transferred from the winding preparation station into the winding station.

This invention also relates to a method for winding a continuously delivered film web onto successively delivered winding tubes into a coil and performing a change of winding tubes for replacing the winding tube, wound with a coil, with a winding tube having a winding apparatus with a contact roller, by which the film web is delivered and transferred to a winding tube rolling on the contact roller and wound up into a coil, and having a transverse-cutting device for the film web for severing the film web, forming a leading end of the trailing cut-off film web for application onto a new winding tube. A delivery device delivers a new winding tube, for replacing the winding tube wound with the coil when winding tubes are changed, wherein at the onset of the change of winding tubes, the new winding tube is placed on the contact roller, forming a contact gap, and the film web is severed either before passing through the contact gap or after passing the through the contact gap. The leading end of the film web formed upon severing of the film web is received by the new winding tube.

Such winding apparatuses are distinguished by the continuously delivered film web being continuously wound up into a coil, and once a predetermined coil diameter is reached, the transfer onward of the complete coil wound onto the winding tube and the delivery of a new winding tube to form a new coil from the film web are automated, without having to interrupt the continuous delivery of the film web.

2. Discussion of Related Art

A conventional winding apparatus is described for instance in German Patent Reference DE 42 13 712 C2 and European Patent Disclosure EP 12 47 773 A2, the disclosure contents of which are incorporated into this specification by reference.

The winding tubes are typically embodied of an electrically nonconductive material, such as cardboard, and are thrust onto a winding shaft, by which the winding tubes are moved and manipulated in the apparatus. Once the film web is wound up, the winding shaft is expelled from the winding tube, and the winding tube then forms the core of the wound-up coil of the film web.

Until now, during a change of winding tubes, the leading end of the trailing film web, created by the transverse-cutting device, is typically transferred onto the new winding tube, such as a cardboard tube disposed on a winding shaft, by providing the circumference of the winding tube with an adhesive, such as an adhesive strip, to which the leading end of the film web adheres on passing through the winding preparation station, thus being taken over by the new winding tube in the winding preparation station. Although this method is proven in practice, it cannot be done advantageously with all kinds of film webs, especially webs of plastic film, because adhesive residues unavoidably adhering to the film web can be disadvantageous in the later processing of the film web wound up to form the coil. Also, applying the adhesive, for instance in the form of adhesive strips, is undesirably complicated.

Various attempts have been made to accomplish the takeover of the leading end, formed during a change of winding tubes, of the film web without the aid of adhesive, which is known as adhesive-free prewinding.

From German Patent Reference DE 36 30 572 C2, it is known for the leading end of the film web, formed by the transverse-cutting device, to be delivered to the new winding tube with the support of suitably aimed blown air in compulsory fashion via a contact-pressure device, which surrounds the periphery of the new winding tube and has a revolving conveyor belt, causing the leading end of the film web to be taken on by the new winding tube. However, in practice a contact-pressure device with a revolving contact-pressure belt does not make it possible under all operating circumstances for the leading end to be received on the new winding tube in a satisfactory and reliable way, particularly above a certain feeding speed of the continuously delivered film web and above a certain thickness of the film web, this contact-pressure device is inadequate.

From European Patent Reference EP 12 47 773 A2, it is known for the leading end of the film web to be charged electrostatically and deflected by blown air onto a new winding shaft. However, in practice this does not always function in satisfactory fashion, because charging the film web is difficult, depending on the plastic used.

From U.S. Pat. No. 4,770,358, a winding apparatus is known which has a rotary arm with two winding tubes. The film web is wound into a coil on a winding tube. Once the winding tube with the coil is finished, the rotary arm is pivoted 180° and the film web is wound into a coil on the second winding tube located on the rotary arm. After the rotary arm is pivoted, the film web is severed by a transverse-cutting knife and blown onto the new winding tube by blown air, which is blown by a blower device onto the top side of the end of the film web, and by electrostatic charging. The winding tubes are connected to one another via the rotary arm and are moved and pivoted in common.

SUMMARY OF THE INVENTION

It is one object of this invention to improve a winding apparatus as defined above, such as known from German Patent Reference DE 42 13 712 C2, so that even at high feeding speeds and/or great film thickness of the continuously delivered film web, a reliable, secure takeover of the leading end, formed by the transverse-cutting device, of the film web onto the new winding tube is achieved without needing adhesives.

This object is achieved with a winding apparatus as defined by definitive characteristics described in this specification and in the claims.

A method according to the invention for performing a change of winding tubes is also described in this specification and in the claims.

This invention can be employed with a conventional winding apparatus, such as known by essential components described, for example, in German Patent Reference DE 42 13 712 C2. According to this invention, the conventional winding apparatus is modified to enable the desired adhesive-free prewinding of the leading end of the film web onto a new winding tube during a change of winding tubes.

According to this invention, downstream, relative to a feeding direction of the film web guided via the contact roller, of the winding preparation station receiving the new winding tube, a charger and a blower device are disposed. With the charger the new winding tube, which is formed of an electrically nonconductive material, can be charged electrostatically. With the blower device, an air stream, acting near or in the region between the surface of the contact roller and the side, toward the contact roller, of the leading end of the film web can be generated counter to the feeding direction of the film web and counter to a direction of rotation of the contact roller, where the end of the film web is lifted from the surface of the contact roller and guided to the new winding tube.

The winding apparatus of this invention, for takeover of the leading end of the film web onto the new winding tube, thus uses an electrostatic charging of the new winding tube, on the basis of which the leading end of the film web automatically adheres to the circumference of the new winding tube and is taken up by it, as a result of which the continuous winding of the film web is continued without interruption. Adhesive is not needed. To accomplish the compulsory application of the leading, electrostatically charged end of the film web to the circumference of the new winding tube, the blown air is also aimed counter to the feeding direction of the film web and in the direction of the circumference of the new winding tube and acts on the side of the film web oriented outward, remote from the new winding tube. Thus the leading end of the film web is deflected onto the new winding tube and adheres to the winding tube because of the electrostatic charge thereof. In particular, the air stream from the blower device can be aimed at a tangent to the surface of the contact roller.

With the charger, an electric voltage field is formed between the film web and the winding tube.

The winding tubes are produced from an electrically nonconductive material, such as a suitable plastic or cardboard. They have a surface resistance, so that the desired static charge can be accomplished.

The method of this invention is for winding a continuously delivered film web onto successively delivered winding tubes into a coil and for performing a change of winding tubes for replacing the winding tube, wound with a coil, with a new winding tube. The method can be used in winding apparatuses that include a contact roller, by way of which the film web is delivered and transferred to a winding tube rolling on the contact roller and wound up into a coil, a transverse-cutting device for the film web for severing the film web, forming a leading end of the trailing, cut-off film web for application onto a new winding tube, and a delivery device for delivering a new winding tube, for replacing the winding tube wound with the coil upon a change of winding tubes. In such apparatuses, the new winding tube is placed on the contact roller, forming a contact gap, and the film web is severed either before passing through the contact gap or after passing through the contact gap. The leading end of the film web formed upon severing of the film web is received by the new winding tube. To accomplish the adhesive-free prewinding, of the cut-off leading end of the film web on the new winding tube of an electrically nonconductive material, the new winding tube is electrostatically charged, and the leading end of the film web is deflected from the contact roller in the direction of the circumference of the new winding tube by blown air oriented counter to the feeding direction of the film web and counter to the direction of rotation of the contact roller, which blown air is directed into the region between the surface of the contact roller and the side, toward the contact roller, of the leading end of the film web.

The charger can preferably be formed by a charging electrode extending transversely over the full width of the new winding tube. The charging electrodes are available on the market for the most various uses.

Various charging methods are available. For example, it is possible to connect the charging electrode to a source of direct voltage, while the other parts of the winding apparatus of this invention are grounded. Because of the electrostatic field created, the film web will continue to adhere to the circumference of the new winding tube because of the deflection by blown air.

To create adequate adhesion of the leading end of the film web to the circumference of the new winding tube, the charger is acted upon by an electrical potential of up to 40 kV.

The blower device of the winding apparatus of this invention includes many blower nozzles, disposed over the full width of the new winding tube, which are acted upon uniformly, via a central connection line, with compressed air from a suitable compressed air source. Because of the charging electrode extending over the full width of the new winding tube, there are so many blower nozzles disposed over the full width of the new winding tube, and the blower nozzles also have equal spacings from one another, the leading end of the film web is applied uniformly to the circumference of the new winding tube and is taken over by it.

Also, the blower device and/or the charger can be disposed on a pivot mount, and upon a change of winding tubes can be moved from a position of repose into a working position and back into the position of repose again after the conclusion of the change of winding tubes, so that only for a duration of a change of winding tubes these devices in the working position, and during the remaining time they are located in a protected position of repose, in which they do not hinder the further function of the winding apparatus.

Also, the charger and the blower device are activated, by a suitable controller, only during the length of time of the change of winding tubes, while during the remaining time in operation of the winding apparatus of this invention they are deactivated. In such time, there is no need for the operation of the charger and the blower device. This activation as needed of the charger and the blower device can easily be integrated into the sequence controller of the winding apparatus of this invention.

This invention can be employed in a winding apparatus, such as described in German Patent Reference DE 42 13 712 C2, in which the contact roller can be driven selectively in a variable direction of rotation, so that the film web can be wound up into the coil with the desired orientation.

In one method according to this invention, for performing a change of winding tubes in conjunction with a winding apparatus of the invention, for performing a change of winding tubes, the transverse-cutting device is moved into a position between a winding preparation station and a winding station. The winding tube is brought into the winding preparation station by the delivery device, and the new winding tube, before being set down in the winding preparation station, is set into rotary motion on the contact roller, and the charger is activated for the duration of at least one revolution of the new winding tube. Electrostatic charging of the surface of the new winding tube is effected, and then the new winding tube is placed on the contact roller, forming the contact gap. The transverse-cutting device is then activated, and by the transverse-cutting knife, the film web is severed, and simultaneously with the crosswise cutting of the film web, the blower device is activated and an air stream is generated. The new leading end of the trailing film web, which end is formed in the transverse-cutting device, is lifted from the surface of the contact roller by the air stream and is guided by the static charge to the new winding tube and wound up. Also, the winding tube, wound with the coil, is removed from the winding station, and then the new winding tube, with the wound-on end of the film web, is transferred from the winding preparation station into the winding station for winding a new coil.

The electrostatic charging according to this invention of the new winding tube is thus already accomplished in the acceleration phase of the new winding tube. The tube is accelerated to the rotary speed corresponding to the circumferential speed of the contact roller before being set down on and rolling along the contact roller. During this acceleration phase, the charger is activated for the duration of at least one complete revolution and preferably a plurality of revolutions of the new winding tube, so that a uniform electrostatic charge of the entire circumferential surface of the new winding tube can be achieved.

Not until the new winding tube, accelerated to the requisite rotary speed as described, has been charged electrostatically over its entire circumference is it placed on and rolls along the contact roller. As immediately as possible after that, the crosswise cutting process of the film web is tripped, and at the same time or even just before, the blower device is switched on.

The newly formed leading end of the film web is then reliably deflected onto the new winding tube, or is lifted from the contact roller, and adheres to the new winding tube automatically because of the electrostatic charge.

The winding apparatus embodied according to this invention and the method of this invention, which use a charger and a blower device in order to apply the leading end of the film web onto the circumference of the new winding tube without using adhesives, can also be retrofitted at little expense in installed winding apparatuses. All that is required is to dispose a suitable blower device and a suitable charger in a suitable position in the winding apparatus, which has been installed in a system for producing and winding films, and to integrate it into the control sequence. The adhesive-free prewinding enabled within the scope of this invention can thus be retrofitted at little expense even into existing winding apparatuses of various configurations.

BRIEF DESCRIPTION OF THE DRAWINGS

This invention is described in view of exemplary embodiments in conjunction with the drawings, wherein.

DESCRIPTION OF PREFERRED EMBODIMENTS

Figure 1:
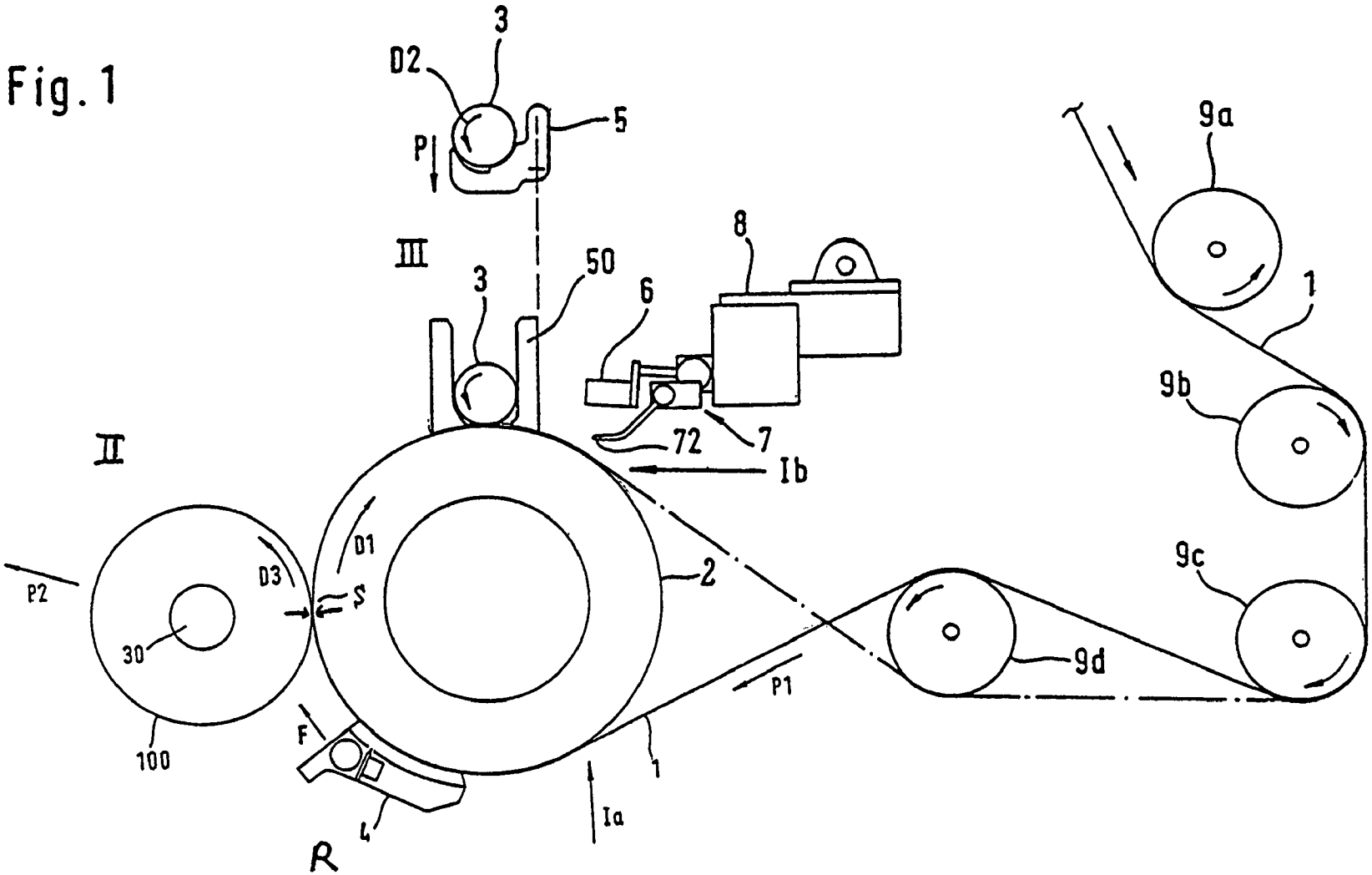
FIG. 1 schematically shows a side view of a winding apparatus according to one embodiment of this invention, with a contact roller, during a winding operation.

FIG. 1 shows, in a highly simplified schematic view, a winding apparatus for winding a continuously delivered film web 1, in particular a web of plastic film. Only the essential components for performing the winding operation are shown. The film web 1 is delivered from an extruder, such as a blow-molded film extruder or flat film extruder, to a contact roller 2 via many deflection rollers 9*a*, 9*b*, 9*c*, 9*d*. The contact roller 2 is driven by a motor, not shown, and can be rotated either clockwise D1, or counterclockwise. In the exemplary embodiment of FIG. 1, the contact roller 2 rotates clockwise D1, and the film web 1 is guided onto the contact roller 2 at the delivery station Ia. If the contact roller 2 is rotated counterclockwise, then as shown in phantom lines the film web 1 runs onto the contact roller 2 in the delivery station Ib. The film web 1, delivered to the contact roller at Ia, is carried along by the contact roller 2 to the winding station II, where at the contact gap S it is transferred to the winding tube 30, which is thrust onto a winding shaft, not shown, and wound onto the winding tube 30 in the direction of the arrow D3 to form a coil 100. The winding tube 30 is made from an electrically nonconductive material, such as cardboard. The winding tube 30, the coil that is slowly wound up, is rotated in the direction of rotation D3 by driving contact at the contact gap S by the contact roller 2. The winding tube 30 with the coil 100 wound on it, located in the winding station II, can be removed from the contact roller 2 in the direction of the arrow P2 once the coil 100 has attained a desired size. The winding station II is associated with the contact roller 2 in a 9 o'clock position, in the example shown. The winding preparation station III is associated with the contact roller 2 in the 12 o'clock position and has with a delivery device 5 for new winding tubes 3, which are transferred into the winding station II after the winding tube 30, wound with a coil 100, has been removed from the winding station II. The new winding tubes 3 are likewise each thrust onto a respective winding shaft, in a manner not shown but known to those skilled in the art, and like the winding tube 30 comprise an electrically nonconductive material, such as cardboard. The winding preparation station III also includes a storage receptacle 50 for the winding shaft with a new winding tube 3. The blower device 7 is also associated with blower nozzles 72 for blown air, and the charger 6 for electrostatic charging is associated with the winding tube 3 in the winding preparation station III. The charger 6 and the blower device 7 are mounted on the pivotably embodied mount.

The transverse-cutting device 4 includes a transverse-cutting knife 41 and a deflection roller 40 for the film web 1. At a time when the winding tube located in the winding station II is wound with a coil, the transverse-cutting device 4 is in a position of repose R in a region between the delivery station Ia and the winding station II. Once the winding tube with the coil is removed from the winding station II in the direction of the arrow P2, the transverse-cutting device is pivoted in the direction of the arrow F into the working position A, shown in FIG. 2*a* in view of FIG. 2*b*. The working position A of the transverse-cutting device 4, for severing the film web 1, is located between the winding station II and the winding preparation station III.

Winding the film web 1 onto a winding tube and changing winding tubes is explained in view of FIGS. 1, 2*a*, 2*b*, and 3.

The film web 1 travels in the feeding direction P1 onto the contact roller 2, rotating in the direction of rotation D1, in the delivery station Ia, which corresponds to a 5 o'clock position, and is carried along by the contact roller 2 as far as the winding station II. The winding station II is in a 9 o'clock position relative to the contact roller 2, and the film web 1 is wound onto the winding tube 30, which because of its contact with the contact roller 2 rotates with it in the direction of the arrow D3, to form the coil 100. With the winding shaft (not shown) pressed into it, the winding tube 30 is supported rotatably and displaceably and makes it possible for the coil 100 to roll along the contact roller 2 at the contact gap S.

Figure 2A:
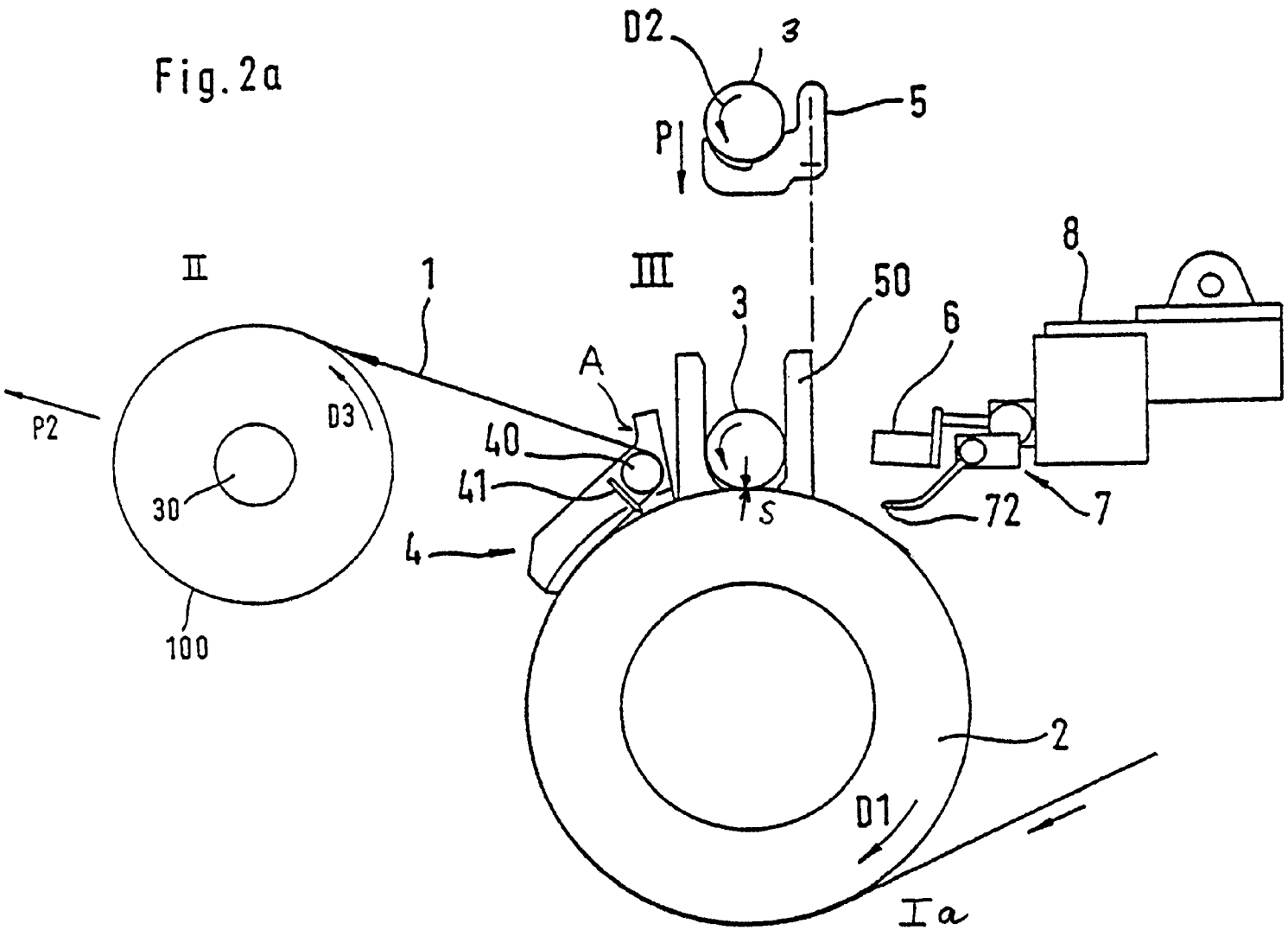
FIG. 2*a* schematically shows an ending of a winding operation of the winding apparatus of FIG. 1, and a beginning of a change of winding tubes.

Once the coil 100 reaches a predetermined circumference, or the desired length of the film web has been wound up, a change of winding tubes is performed, in which the full winding tube 30, wound with the coil, is removed in the direction of the arrow P2 and replaced with a new, still-empty winding tube 3. For this change of winding tubes, the winding preparation station III is provided in the 12 o'clock position relative to the contact roller 2, in which a new, still-empty winding tube 3 is put in place and put in contact with the contact roller 2, as shown in FIG. 2*a*. The new winding tube 3, not thrust onto a winding shaft, not shown, is taken from a magazine, not shown, by a delivery device 5, which at the same time includes a device for rotating and accelerating the winding tube 3 in the direction of rotation D2, so that the winding tube 3 can be deposited from the delivery device 5 in the direction of the arrow P into the storage receptacle 50 at the contact roller 2, at the time when the winding tube 3 reaches the desired rotary speed, corresponding to the circumferential speed of the contact roller 2. The new winding tube 3 is placed on the contact roller 2, forming a contact gap S, and is entrained in rotation by the contact roller 2 in the direction D2.

In terms of the feeding direction D1 of the contact roller 2, a charger 6 and a blower device 7 for blown air are disposed downstream of the winding preparation station III.

As shown in FIG. 1, initially, during continuous winding of the film web 1 to form the coil 100, the transverse-cutting device 4 is located in a position between the delivery station Ia and the winding station II. For the change of winding tubes to be performed, the replacement of the full winding tube 30 in the winding station II with the new winding tube 3, the full winding tube 30 with the coil 100 is removed in the winding station II from the contact roller 2 in the direction of the arrow P2, as shown in FIG. 2*a*, and the transverse-cutting device 4 moves in the direction of the arrow F out of the position of repose R of FIG. 1, between the contact roller 2 and the winding tube 30 removed from the contact roller 2, into the working position A, or cutting position, as shown in FIG. 2*a*. In this way, the transverse-cutting device 4 carries the film web 1 along with it, which is now carried from the contact roller 2 onto a deflection roller 40 disposed on the transverse-cutting device 4, and from there travels onward for winding onto the coil 100 on the winding tube 30.

Figure 3:
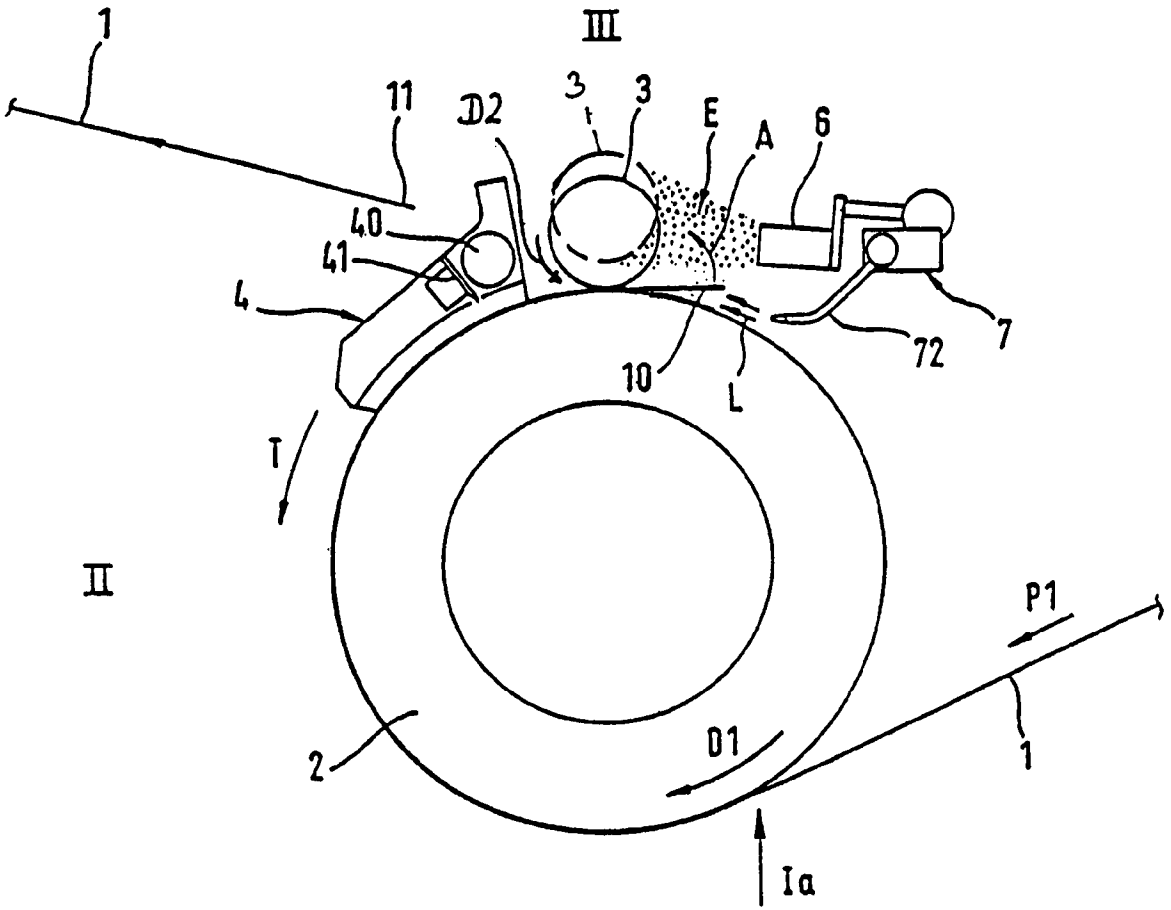
FIG. 3 is an enlarged schematic view showing a detail of the process of prewinding a new winding tube with a film web upon a change of winding tubes as shown in FIGS. 2*a* and 2*b*.

Next, or in parallel with it, the new winding tube 3 in the winding preparation station III is accelerated to its rotary speed D2 in the delivery device 5, but it does not yet rest on the contact roller 2, as shown in FIG. 3 from the position shown in dashed lines of the new winding tube.

Immediately after the onset of acceleration of the new winding tube, and as long as the new winding tube is not yet in contact with the contact roller 2, the charger 6 is also activated for electrostatically charging the surface of the new winding tube 3.

The charger 6 generates a strong electrical field, which because the winding tube 3 is made of a nonconductor, an electrically nonconductive material, such as cardboard or plastic, generates the desired electrostatic charge on the surface thereof.

At least for the duration of one complete revolution of the new winding tube that is in the acceleration phase, but preferably for a plurality of revolutions, the charger 6 remains activated, so that a uniform electrostatic charge is attained over the entire circumferential surface of the new winding tube 3. As soon as the new winding tube has been accelerated to the desired rotary speed and charged electrostatically as described above, it is placed by the delivery device 5 in the storage receptacle 50 of the winding preparation station III, until it touches the contact roller 2 in the contact gap S and is carried along it by rolling on it.

Figure 2B:
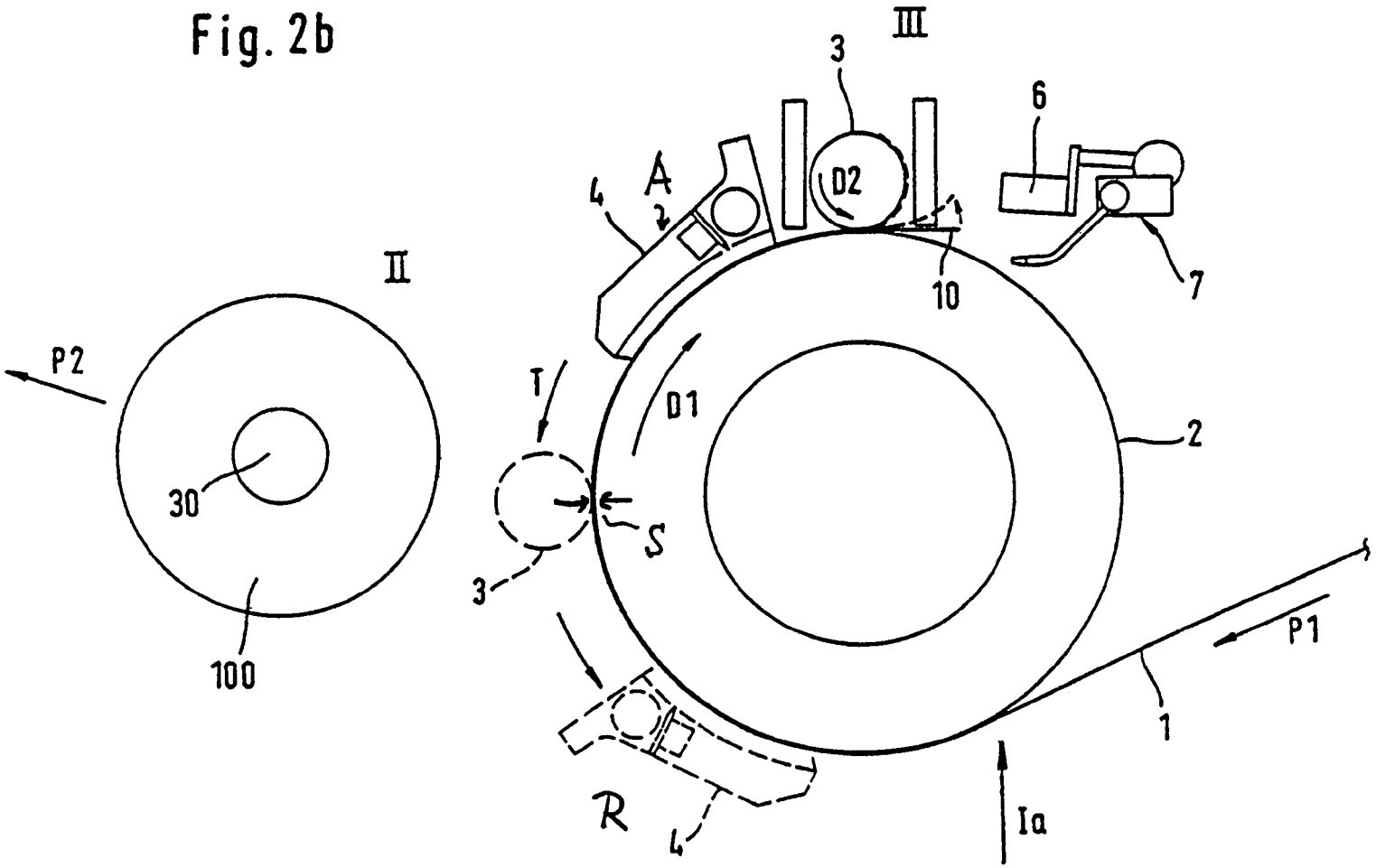
FIG. 2*b* schematically shows the change of winding tubes of the winding apparatus of FIG. 1, and an ending of the change of winding tubes.

The transverse-cutting knife 41 of the transverse-cutting device 4 is now activated and severs the film web 1, guided around the transverse-cutting device 4, in the position just before reaching the winding station III, as shown in FIG. 2*a* and FIG. 3. Parallel to the cutting operation, the blower device 7 is activated, and blown air from the nozzles 72 is blown counter to the feeding direction D1 of the film in the direction of the new winding tube 3. Because the film web is cut crosswise with the transverse-cutting knife 41, the leading end of the film web 1 is drawn with its trailing end 11 in the direction of the winding tube 30 of the winding station II, as shown in FIG. 3, and forms the end of the coil 100. The new leading end 10 of the film web 1, conversely, remains on the contact roller 2 and is transported with it in the direction D1 to the winding preparation station III and is guided through the contact gap S between the contact roller 2 and the winding tube 3, as shown in FIG. 2*b* and FIG. 3. As soon as the leading end 10 of the film web has passed through the contact gap, it comes under the influence of the air stream L from the blower device 7, as shown in FIG. 3.

The end 10 of the leading film web 1 is lifted in the direction of the arrow A from the contact roller 2 by the air stream, which flows counter to the feeding direction of the film web between the surface of the contact roller 2 and the underside, toward the contact roller, of the end 10 of the film web and is guided onto the new winding tube 3 by the static charge E of the winding tube and adheres to the new winding tube 3 and is carried along with it in the direction of rotation D2, and thus the film web 1 is in turn wound up by its end 10. During this prewinding of the end of the film web 1 onto the new winding tube 3 in the winding preparation station III, the winding tube 30, wound with the coil 100, is removed from the winding station II in the direction of the arrow P2, and the transverse-cutting device 4 is also pivoted back into the position of repose between the winding station II and the delivery station Ia in the direction of the arrow T, as shown in FIGS. 2*b* and 3. Now, the new winding tube 3, provided with the end 10 that is taken up from the film web 1, can also be pivoted out of the winding preparation station III into the winding station II in the direction of the arrow T, as shown in FIG. 2*b*. The further process of winding the film web 1 onto the new winding tube 3 can then be performed in the winding station II as described in conjunction with FIG. 1.

In FIG. 3, the operation of adhesive-free prewinding of the end 10 of the film web 1 is shown schematically. Downstream of the winding preparation station III, in terms of the feeding direction D1 of the film web 1, are the charger 6, in the form of a charging electrode extending transversely over the full width of the new winding tube 3, and a blower device 7, in the form of many blower nozzles 72 disposed in a row transversely to the length of the film web 1 and over its full width. The charger 6 and the blower device 7 are disposed on the same mount 8 and are pivotable with it either jointly or individually. The charging electrode of the charger 6 is disposed at some distance from the winding tube 3 and is oriented toward it.

With the charging electrode of the charger 6, a strong electrostatic field E is generated, by which the new winding tube 3 in the winding preparation station III is electrostatically charged within an extremely brief time in the position shown in dashed lines in FIG. 3, before it contacts with the contact roller 2, and while it is accelerated to its desired rotary speed corresponding to the circumferential speed of the contact roller. An air stream L which is oriented counter to the feeding direction D1 of the film web 1 and at a tangent to the surface of the contact roller is generated by the blower device 7 and aimed at the new winding tube 3. The nozzles 72 are disposed so that the emerging air stream L meets the side of the film web 1 remote from the winding tube 3, the side previously resting on the surface of the contact roller, and thus the film web 1 lifts from the surface of the contact roller 2 and is deflected in the direction of the winding tube 3. At the same time, because of the electrostatic charge of the new winding tube 3, the film web 1 is also attracted by the new winding tube 3, the closer it comes to the surface of the new winding tube 3. Thus, the leading end 10 of the film web 1 automatically adheres because of the electrostatic charge to the surface of the new winding tube 3 and is carried along it in the direction of rotation D2, resulting in an automatic, uniform prewinding and winding of the continuously delivered film web 1 by its end 10 onto the new winding tube 3. Once the end 10 of the film web is wound with firm contact on the new winding tube 3, the transfer of the new winding tube 3, with the film web 1 received on it, to the winding station II is performed, for instance in the manner described in German Patent Reference DE 42 13 712 C2.

The electrical field generated by the charger 6 is generated by a high potential difference of up to 40 kV, and for instance 30 kV, and at the time the blower device 7 generates a very sharp air stream L that acts at high speed on the side of the leading end 10 of the film web 1 that is lifting from the contact roller, the air stream is counter to the feeding direction D1 of the film web 1. This combination assures that the leading end 10 of the film web 1 is reliably lifted from the contact roller, even at a very high feeding speed D1, by the contact roller and a correspondingly high rotary speed of the contact roller 2 and deflected onto the new winding tube 3 in the winding preparation station III and adheres there.

The winding apparatus shown in FIG. 1 is also embodied so that depending on the desired orientation of the film web 1, wound into a coil, the contact roller 2 can be operated with a variable direction of rotation, such as described in German Patent Reference DE 42 13 712 C2. Thus not only can the winding apparatus of FIG. 1 be operated with a contact roller 2 driven to rotate clockwise D1, producing the course of the film web 1 indicated by solid lines; counterclockwise operation of the contact roller is also possible, producing the course of the film web 1 indicated by phantom lines, and the film web 1 is guided in the station Ib onto the contact roller 2.

Figure 4:
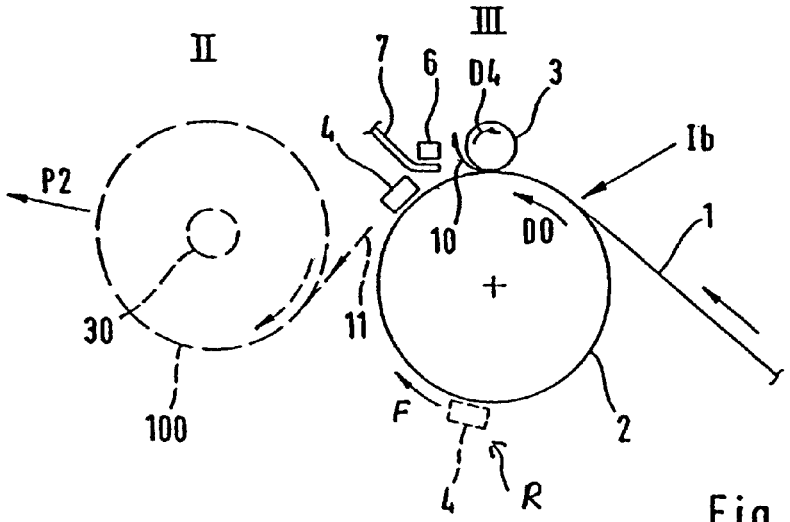
FIG. 4 schematically shows the winding apparatus upon prewinding of a new winding tube in the delivery of the film web to a contact roller, which rotates counterclockwise, in the winding apparatus of FIG. 1.

Even in this kind of operating state, with a delivery station Ib for the film web 1, the adhesive-free prewinding of a new winding tube 3 already described in the winding preparation station III for performing a change of winding tubes is possible, as shown in FIG. 4. Here the charger 6 and the blower device 7 are disposed downstream of the winding preparation station III that carries the new winding tube 3, in terms of the direction of rotation of the contact roller 2, represented by the arrows D0 in FIG. 4, and the feeding direction of the film web and they are disposed approximately at an 11 o'clock position of the contact roller 2 and in a region where the transverse-cutting device 4 is also disposed in its activated position. In this case as well, by the action of the charger 6 and blower device 7 on the leading end 10 of the film web 1 formed by the transverse-cutting device 4, this end can be deflected from the surface of the contact roller 2 toward the surface of the new winding tube 3, to which it adheres because of the electrostatic charging of the winding tube 3 generated by the charger 6. After that, the new winding tube 3 can be transferred to the winding station II, and the film web can be continuously wound into a new coil.

The winding apparatus and the method of this invention enable adhesive-free prewinding of a new winding tube during a change of winding tubes in a reliable way, and in particular even at high delivery speeds of the film web 1 of over 100 m/min, for instance, and/or film thicknesses of over 0.050 mm. The winding apparatuses of this invention can thus also be used with powerful extruders for the continuous production of film webs.

German Patent Reference 020 23 945.5, the priority document corresponding to this invention, and its teachings are incorporated, by reference, into this specification.

What is claimed is:

1. An apparatus for winding a continuously oncoming film web (1) onto successively deliverable winding tubes, including a rotatably drivable contact roller (2) for delivering the film web (1) in a feeding direction, and as associated with the contact roller (2) the apparatus comprising:

a winding station (II) for a first winding tube (30), located in the winding station (II), for winding the film web (1) into a coil (100);

a winding preparation station (III) for receiving a second winding tube (3) which upon a change of winding tubes replaces the first winding tube (30) wound with the coil (100) of the film web (1) in the winding station (II);

a transverse-cutting device (4) for cutting the film web (1) crosswise in a region between the winding station (II) and the winding preparation station (III);

upon a change of the winding tubes, the winding tube bearing the coil removable from the winding station (II), the transverse-cutting device (4) for cutting the film web (1) crosswise transferable from a position of repose into a working position, and upon severing of the film web (1), a leading end (10) of the trailing film web (1) being formed, the formed leading end (10) of the film web (1) deliverable to the second winding tube (3) located in the winding preparation station (III) and wound onto the second winding tube (3), and the new winding tube (3) after receiving the leading end (10) of the film web (1) being transferable from the winding preparation station (III) into the winding station (II); and downstream with respect to the feeding direction of the film web (1) guided via the contact roller (2), of the winding preparation station (III) receiving the second winding tube (3), a charger (6) and a blower device (7) being disposed, and with the charger (6) the second winding tube (3) formed of an electrically nonconductive material electrostatically chargeable, and with the blower device (7) an air stream (L) acting in a second region between a surface of the contact roller (2) and a side toward the contact roller (2) of the leading end (10) of the film web (1) being generated counter to the feeding direction of the film web (1) and counter to a direction of rotation of the contact roller (2), and the end (10) of the film web (1) being lifted from the surface of the contact roller (2) and guided to the second winding tube (3).

2. The winding apparatus of claim 1, wherein the air stream (L) from the blower device (7) is carried at a tangent to the surface of the contact roller (2).

3. The winding apparatus of claim 2, wherein the charger (6) is formed by a charging electrode that extends transversely over an entire width of the winding tube (3).

4. The winding apparatus of claim 3, wherein the blower device (7) has a plurality of blower nozzles (72) disposed over the entire width of the winding tube (3).

5. The winding apparatus of claim 4, wherein upon a change of the winding tubes at least one of the blower device (7) and the charger (6) movable out of a position of repose into a working position and after an end of the change of the winding tubes is movable back to the position of repose.

6. The winding apparatus of claim 5, wherein the charger (6) is acted upon by an electrical potential of up to 40 kV.

7. The winding apparatus of claim 6, wherein the contact roller (2) is selectively driven with a variable direction of rotation.

8. The winding apparatus of claim 1, wherein the charger (6) is formed by a charging electrode that extends transversely over an entire width of the winding tube (3).

9. The winding apparatus of claim 1, wherein the blower device (7) has a plurality of blower nozzles (72) disposed over the entire width of the winding tube (3).

10. The winding apparatus of claim 1, wherein upon a change of the winding tubes at least one of the blower device (7) and the charger (6) movable out of a position of repose into a working position and after an end of the change of the winding tubes is movable back to the position of repose.

11. The winding apparatus of claim 1, wherein the charger (6) is acted upon by an electrical potential of up to 40 kV.

12. The winding apparatus of claim 1, wherein the contact roller (2) is selectively driven with a variable direction of rotation.

13. A method for winding a continuously delivered film web (1) onto successively delivered winding tubes (3) into a coil (100) and performing a change of the winding tubes for replacing a first winding tube (30) wound with a coil, with a second winding tube (3), having a winding apparatus with a contact roller (2) by which the film web (1) is delivered and transferred to the second winding tube (3) rolling on the contact roller (2) and wound up into the coil (100), and having a transverse-cutting device (4) for severing the film web (1), forming a leading end (10) of the trailing cut-off film web (1) for application onto the second winding tube (3), and having a delivery device (5) for delivering the second winding tube (3), for replacing the first winding tube (30) wound with the coil (100) when the winding tubes are changed, wherein the second winding tube (3) is placed on the contact roller (2) forming a contact gap (S), and the film web (1) is severed one of before passing through the contact gap (S) and after passing through the contact gap (S), and the leading end (10) of the film web (1) formed upon severing of the film web (1) is received by the second winding tube (3), the method comprising: the second winding tube (3) formed of an electrically nonconductive material, the second winding tube (3) electrostatically charged, the leading end (10) of the film web (1) deflected from the contact roller (2) in a direction of a circumference of the second winding tube (3) by blown air oriented counter to a feeding direction of the film web (1) and counter to a direction of rotation of the contact roller (2), and the blown air being blown into a region between a surface of the contact roller (2) and a side toward the contact roller (2) of the leading end (10) of the film web (1).

14. The method of claim 13, wherein for performing a change of the winding tubes, the transverse-cutting device (4) is moved into a position between a winding preparation station (III) and a winding station (II); the second winding tube (3) is brought into the winding preparation station (III) by the delivery device (5), and the second winding tube (3) before being set down in the winding preparation station (III) is set into rotary motion (D2) on the contact roller (2), and a charger (6) is activated for a duration of at least one revolution of the second winding tube (3); an electrostatic charging of the surface of the second winding tube (3) is effected, and then the second winding tube (3) is placed on the contact roller (2), forming the contact gap (S); the transverse-cutting device (4) is then activated and by the transverse-cutting knife (41), the film web (1) is severed, and simultaneously with the crosswise cutting of the film web (1), the blower device (7) is activated and an air stream (L) is generated; the leading end (10) of the trailing film web (1) which end is formed in the transverse-cutting device (4) is lifted from the surface of the contact roller (2) by the air stream (L) and is guided by the static charge to the second winding tube (3) and wound up; the winding tube (30) wound with the coil (100) is removed from the winding station (II), and then the second winding tube (3) with the wound end (10) of the film web (1) is transferred from the winding preparation station (III) into the winding station (II) for winding a new coil.

* * * * *